US007520731B1

(12) United States Patent
Langdon, II et al.

(10) Patent No.: US 7,520,731 B1
(45) Date of Patent: Apr. 21, 2009

(54) GAS PRESSURE DRIVEN PUMP HAVING DUAL PUMP MECHANISMS

(75) Inventors: Richard H. Langdon, II, Columbia, SC (US); Neil J. Davies, Columbia, SC (US); Malcolm P. Gordge, Blythewood, SC (US)

(73) Assignee: Spirax Sarco, Inc., Blythewood, SC (US)

( * ) Notice: Subject to any disclaimer, the term of this patent is extended or adjusted under 35 U.S.C. 154(b) by 501 days.

(21) Appl. No.: 11/348,123

(22) Filed: Feb. 6, 2006

(51) Int. Cl.
*F16K 31/18* (2006.01)

(52) U.S. Cl. ..... 417/133; 137/422; 417/127

(58) Field of Classification Search ..... 417/133, 417/126, 127, 130, 131; 137/422
See application file for complete search history.

(56) References Cited

U.S. PATENT DOCUMENTS

| | | | | | |
|---|---|---|---|---|---|
| 122,950 | A | * | 1/1872 | Lytle | 417/131 |
| 1,397,190 | A | * | 11/1921 | Wiggins | 417/132 |
| 1,863,941 | A | | 6/1932 | Rogers | |
| 2,460,011 | A | * | 1/1949 | Hungerford, Jr. et al. | 210/123 |
| 2,832,370 | A | * | 4/1958 | Hill | 137/391 |
| 5,351,713 | A | | 10/1994 | Lin | |
| 5,445,143 | A | | 8/1995 | Sims | |
| 5,470,206 | A | * | 11/1995 | Breslin | 417/131 |
| 5,715,856 | A | | 2/1998 | Martin et al. | |
| 5,938,409 | A | | 8/1999 | Radle, Jr. et al. | |
| 6,089,258 | A | | 7/2000 | Busick et al. | |
| 6,099,260 | A | | 8/2000 | Reynolds | |
| 6,599,096 | B1 | | 7/2003 | Totten et al. | |
| 2004/0151597 | A1 | | 8/2004 | Dukes et al. | |
| 2005/0226734 | A1 | | 10/2005 | Soares | |
| 2008/0060374 | A1 | * | 3/2008 | Gammons et al. | 62/259.3 |

* cited by examiner

*Primary Examiner*—William H Rodríguez
*Assistant Examiner*—Vikansha S Dwivedi
(74) *Attorney, Agent, or Firm*—Nelson Mullins Riley & Scarborough LLP

(57) ABSTRACT

The present invention is directed to a gas pressure driven liquid pump having a pump body, liquid inlet, liquid outlet, a pair of pump mechanisms each including a float, and a baffle within the pump body creating two chambers within the pump body. A separate pump mechanism is configured to operate in the respective chambers. The baffle includes a void located below a low liquid level position so that a liquid seal is maintained between the two chambers. As the pump body fills with liquid condensate, a high liquid level position will trigger the respective pump mechanisms to allow motive gas into the chambers, pumping the liquid out of the pump body.

18 Claims, 4 Drawing Sheets

GAS PRESSURE DRIVEN PUMP HAVING DUAL PUMP MECHANISMS

BACKGROUND OF THE INVENTION

The present invention relates generally to gas pressure driven liquid pumps. More particularly, the present invention relates to an improved gas pressure driven liquid pump utilizing redundant pump mechanisms.

Condensate removal systems in steam distribution arrangements often utilize a motive gas driven pump that functions without electricity. Typically, such pumps include a tank (i.e., pump body) with a liquid inlet and a liquid outlet. The inlet and outlet, located near the bottom of the tank, are equipped with an inlet check valve and an outlet check valve to permit liquid flow in only a pumping direction. A pair of interconnected valves are controlled by a pump mechanism to open and close a gas motive port and a gas exhaust port as desired.

The pump operates by alternating between a liquid filling phase and a liquid discharge phase. During the liquid filling phase, the gas motive port is closed while the gas exhaust port is open. A float connected to a snap acting linkage rises with the level of liquid entering the tank. When the float reaches a high level position, the linkage snaps over to simultaneously open the motive port and close the exhaust port. As a result, motive gas enters the tank and the pump switches to the liquid discharge phase.

In the liquid discharge phase, steam or other motive gas is introduced into the pump tank through the motive port. The motive gas forces liquid out of the tank, causing the float to lower with the level of the liquid. When the float reaches a low level position, the linkage snaps over to simultaneously open the exhaust port and close the motive port. As a result, the pump will again be in the liquid filling phase.

Examples of prior art devices can be found in U.S. Pat. No. 5,938,409 to Radle and U.S. Patent Application Pub. No. 2004/0151597 to Dukes et al., both of which are herein incorporated fully by reference.

SUMMARY

The present invention recognizes and addresses considerations of prior art constructions and methods.

According to one aspect, the present invention provides a pump comprised of a pump body, a plurality of pump mechanisms including respective liquid level indicators, and a baffle within the pump body. The pump body has a liquid inlet and a liquid outlet. Condensate may flow into the pump body through the liquid inlet. The same condensate may be pumped out of the pump body through the liquid outlet. The liquid level indicators, which may comprise respective floats or other suitable mechanisms, are configured to detect the liquid level within the pump body.

The baffle separates the pump body into a first side and a second side. At least one respective liquid level indicator is configured to detect the liquid level in each of the first and second sides. The baffle has a void (which may take the form of a gap at the bottom of the baffle) located below a low liquid level position. The positioning of the void below the low fluid level position facilitates a liquid seal between the first side and the second side of the pump body during pumping.

A high liquid level position within either the first side or the second side triggers fluid communication between the respective side and a motive gas source. The influx of motive gas creates pressure within the pump body such that liquid is forced out of the liquid outlet. When the low fluid level position is reached within either the first side or the second side, fluid communication is initiated between a gas exhaust and the pump body, allowing condensate to enter the pump body through the liquid inlet.

The baffle divides the pump body's interior either crosswise, longitudinally, or in another suitable fashion. The separate first and second sides created by the baffle allow the pump to continue operation if either mechanism ceases to function for any reason, e.g., blocked motive or damaged float.

The accompanying drawings, incorporated in and constituting part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
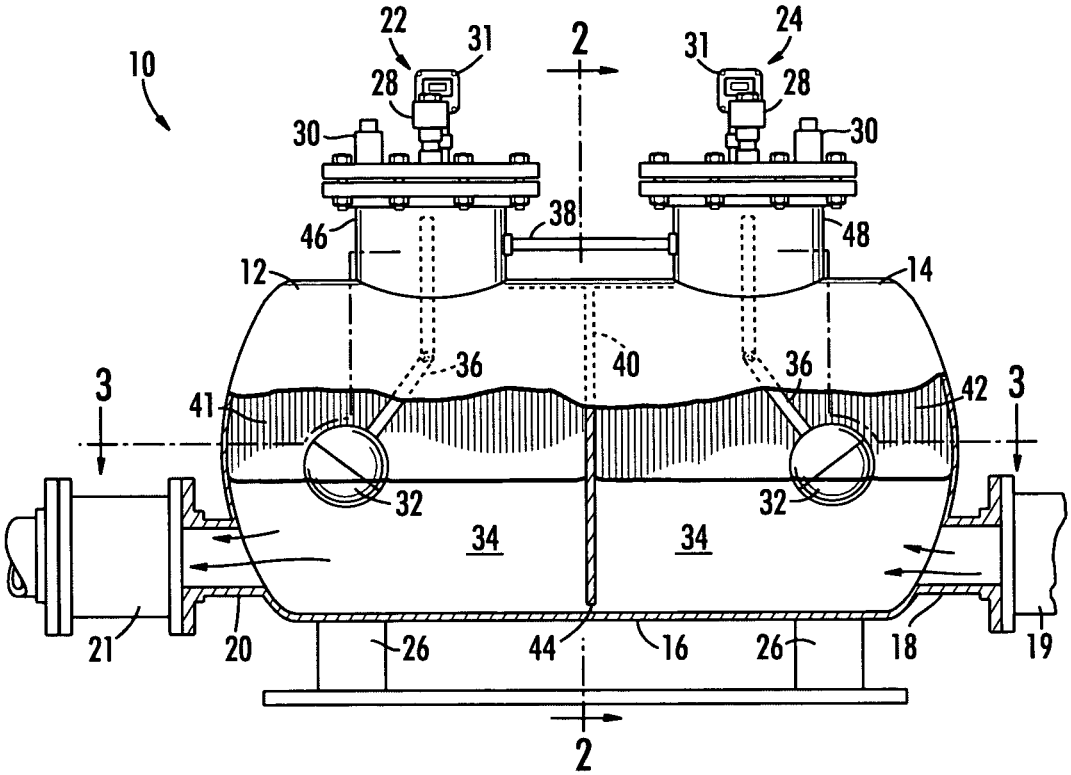
FIG. 1 is a partially cut away side view of a gas pressure driven pump in accordance with an embodiment of the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
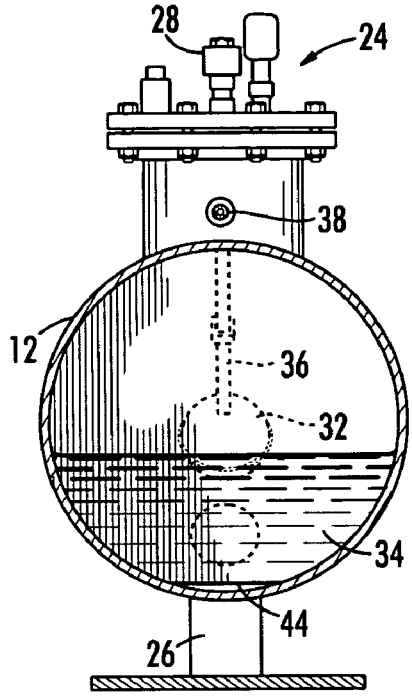
FIG. 2 is a view of the pump in FIG. 1 cut along line 2-2.
Figure 3:
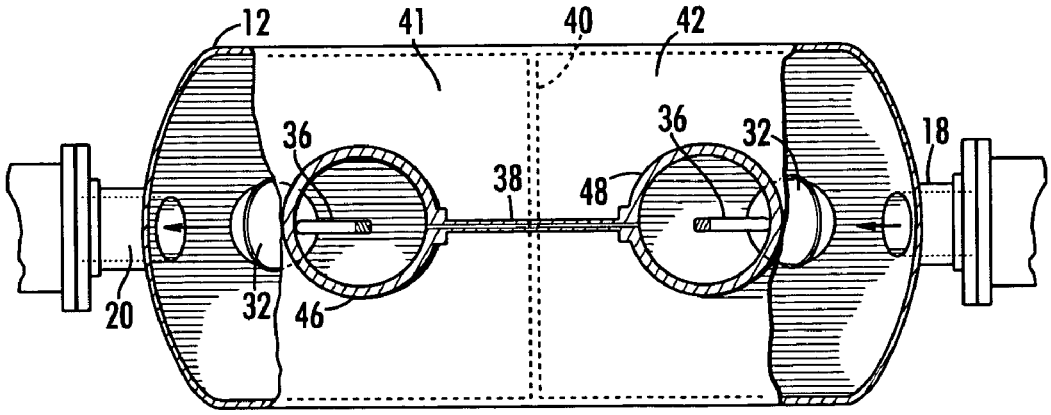
FIG. 3 is a view of the pump in FIG. 1 cut along line 3-3.

FIGS. 1-3 illustrate a gas pressure driven liquid pump 10 constructed in accordance with the present invention. Pump 10 includes a pump body 12 generally having a top 14 and a bottom 16. A liquid inlet 18 allows a liquid to enter pump body 12 near bottom 16. Liquid exits body 12 through a liquid outlet 20, which may be situated on the opposite side of pump body 12 from liquid inlet 18 (or in another suitable location). Pressure driven pump mechanisms 22 and 24 are mounted to cylindrical mounting structures 46 and 48 at top 14 of pump body 12. Pump body 12 optionally includes legs 26 for supporting pump 10 on a flat surface or other desired location.

Liquid inlet 18 and liquid outlet 20 may further include respective check valves 19 and 21 so that the liquid flows only in a desired direction. In the arrangement shown in the Figures, check valve 19 allows a liquid to flow into pump body 12 and check valve 21 allows the liquid to exit pump body 12. Preferably, liquid inlet 18 and liquid outlet 20 are placed below a predetermined low liquid level position such that the liquid level within pump body 12 does not drop below the top of the inlet or outlet. This configuration helps prevent motive gas from entering the check valves during pumping.

As noted above, two pressure powered pump mechanisms 22 and 24 are mounted at top 14 of pump body 12. Each pump mechanism has a gas motive port 28 and a gas exhaust port 30. Within gas motive port 28 is a first valve which controls the introduction of a motive gas into pump body 12. A motive pipe connected to a motive gas source is further connected to gas motive port 28. A second valve is provided within gas exhaust port 30 to allow gas inside of pump body 30 to be exhausted when opened. A preferred snap acting pump mechanism for use in the present invention is shown and described in U.S. Patent Application Pub. No. 2004/0151597. A counter 30 optionally may be provided to record the number of cycles performed by each of the respective pump mechanisms. A preferred counter device for use with the present invention is shown in U.S. Patent Application Pub. No. 2005/0226734 to Soares, herein incorporated fully by reference.

The pump mechanisms each include a liquid level indicator in the form of a float 32 floating in the condensate liquid 34 within pump body 12. Float 32 moves up and down with the liquid level within pump body 12 and mechanically transmits this information to the pressure powered pump mechanism above. Specifically, float 32 is attached to the distal end of a pivoting float arm 36. The angular position of float arm 36 is indicative of the liquid level within pump body 12 due to the buoyancy of float 32. While float 32 responds to the liquid level in this embodiment, those of skill in the art will appreciate that various liquid level indicators are possible.

Pump 10 further includes a baffle 40 located about halfway between liquid inlet 18 and liquid outlet 20. Baffle 40 separates pump body 12 into a first side 41 and a second side 42. Pump mechanism 22 is in fluid communication with first side 41, whereas pump mechanism 24 is in fluid communication with second side 42. Baffle 40 is configured such that pump mechanisms 22 and 24 will have independent air/steam spaces (also referred to as pressure space), while maintaining a common condensate (or pumping) compartment.

As shown, baffle 40 extends from top 14 of pump body 12 to a location near bottom 16. A void in the form of a gap 44 is defined between the bottom of the baffle and the bottom of pump body 12. As can be seen in FIGS. 1 and 2, gap 44 allows liquid 34, entering through inlet 18, to equalize on both sides of baffle 40. That is, the liquid level in first side 41 and second side 42 is approximately equal in a steady state condition. Although gap 44 could be located at other locations along baffle 40, placing the void at the bottom of baffle 40 ensures that a liquid seal exists between the void and the portion of first side 41 or second side 42 above liquid 34.

With baffle 40 configured as in FIGS. 1 through 3, gap 44 preferably is below the low liquid level position. In addition, since one of gas motive ports 28 in pump mechanisms 22 and 24 will often open first, gap 44 enables liquid from the side that first fills with gas to momentarily raise the liquid level in the other side. This momentary rise in the other side's liquid level then opens the gas motive port on that side so that both gas motive ports 28 are open during the liquid discharge pumping phase.

Pump 10 also includes a passage in the form of an equalizing tube 38 between mounting structures 46 and 48 for pump mechanisms 22 and 24, respectively. As a result, the pressure spaces on each side of baffle 40 will be in controlled fluid communication. Tube 38 enables a more equalized flow of liquid out of both first side 41 and second side 42 during liquid discharge by substantially equalizing the pressure in the two sides. In the unlikely event that one of pump mechanisms 22 and 24 fails, tube 38 helps prevent liquid from one side from filling the other side before exiting through liquid outlet 20. One skilled in the art will appreciate that the cross-sectional area of tube 38 may be selected based on the size of a particular pump. In this regard, a ¾ inch pipe has worked well with a 50 gallon pump body.

In the embodiment shown in FIGS. 1 through 3, the ratio of the cross-sectional area of gap 44 to the effective cross-sectional area of the liquid inlet 18 and/or liquid outlet 20 may be "tuned" to ensure that the liquid flows properly through liquid outlet 20. In this regard, the opening defined by baffle 40 may preferably have a cross-sectional area equal to or greater than the effective cross-sectional area of either the liquid inlet or liquid outlet, whichever of the two is greater. In the embodiment shown in FIGS. 1 through 3, the cross-sectional area of flow allowed by check valves 19 and 21 is the limiting cross-sectional area. The flow area of the check valves is thus used in determining the effective cross-sectional area of the inlet and outlet, as well as the area under the baffle. If the area under the baffle is too large, then the liquid levels in first and second sides 41 and 42 may not be equal during liquid discharge.

The pump's operation will now be discussed. Pump 10 incorporates two pressure powered pump mechanisms 22 and 24 that alternately pressurize and vent pump body 12 to achieve pumping. In the normal position before startup, floats 32 are at their predetermined low level positions, the gas motive ports are closed, and the gas exhaust ports are open. When liquid flows by gravity, or otherwise, through liquid inlet 18 and check valve 19, the floats rise until the predetermined high level positions are reached. At this point, the mechanisms open gas motive ports 28 and close gas exhaust ports 30. Motive gas is admitted to both sides of the pump body causing the pump body to pressurize and discharge liquid through liquid outlet 20 and check valve 21.

As the liquid level in the pump body decreases, the floats fall until the predetermined low level position is reached. When that point is reached, the mechanisms close the gas motive ports and open the gas exhaust ports. The pump body then vents excess pressure. Liquid will then flow through the liquid inlet and fill the pump body, repeating the cycle.

Figure 4:
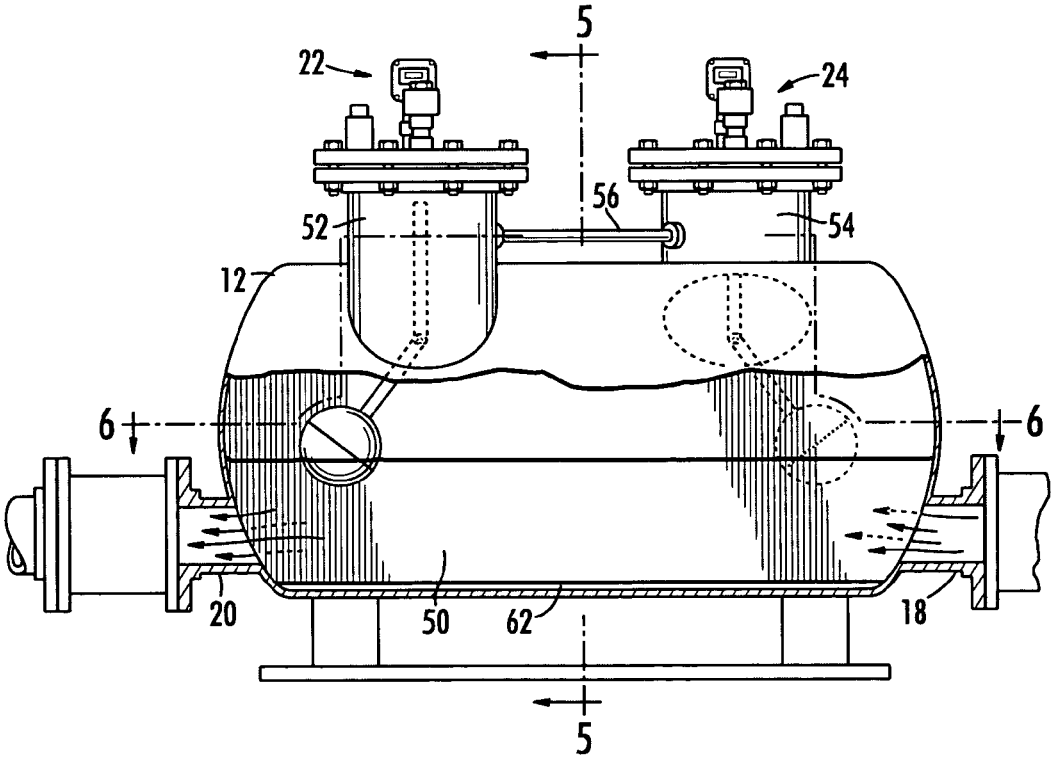
FIG. 4 is a partially cut away side view of a gas pressure driven pump in accordance with another embodiment of the present invention.
Figure 5:
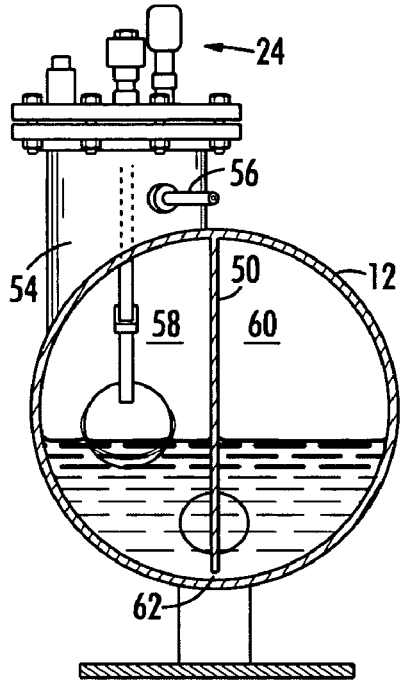
FIG. 5 is a view of the pump in FIG. 4 cut along line 5-5.
Figure 6:
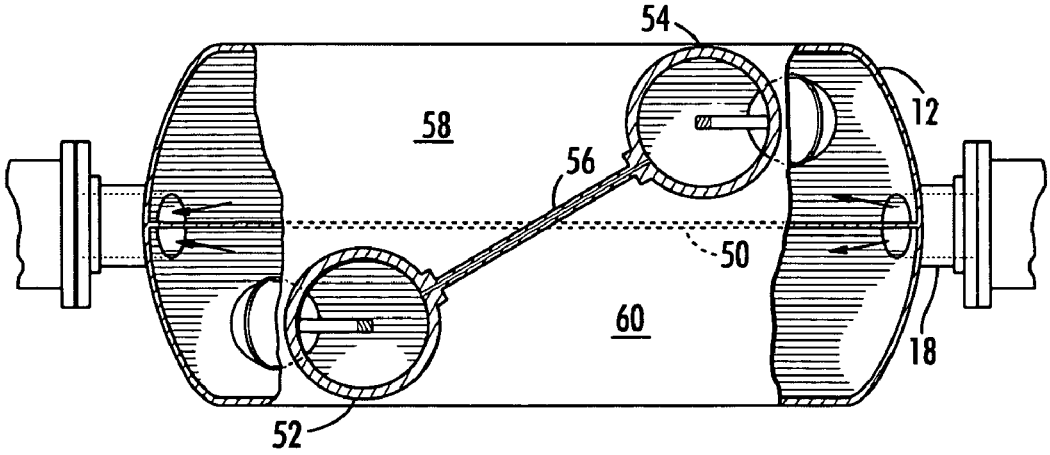
FIG. 6 is a view of the pump in FIG. 4 cut along line 6-6.

Referring now to FIGS. 4 through 6, a second embodiment of the present invention is shown. This embodiment utilizes a similar pump body 12, liquid inlet 18, and liquid outlet 20 to the embodiment shown in FIGS. 1 through 3. This embodiment, however, utilizes a longitudinal baffle 50 that divides pump body 12 longitudinally rather than cross-wise.

As shown in FIG. 6, mounting structures 52 and 54 (on which pressure powered pump mechanisms 22 and 24 are mounted) are located at the top of pump body 12 on opposite lateral sides of longitudinal baffle 50. The operation of pump mechanisms 22 and 24 is the same as previously discussed for the embodiment shown in FIGS. 1 through 3. Similar to tube 38, a tube 56 provides fluid communication between mounting structures 52 and 54. This enables a more equalized flow of liquid out of both first side 58 and second side 60 during liquid discharge by equalizing the pressure between the two sides.

Longitudinal baffle 50 not only divides pump body 12, but it also divides liquid inlet 18 and liquid outlet 20. A void in the form of gap 62 is provided at the bottom of baffle 50 to allow the liquid to equalize between both sides of pump body 12.

When using a longitudinal baffle configuration that divides the liquid inlet and outlet, a first side 58 and a second side 60 will fill and drain at about the same rate without "tuning" the ratio of area under the baffle to inlet/outlet cross-sectional area. With a cross-sectional baffle, such as baffle 40, some "tuning" may be necessary. In this context, "tuning" is used to refer to an iterative process by which the area under the baffle is selected and tested based on the effective cross-sectional areas of either/both of the liquid inlet and liquid outlet.

In the embodiment shown in FIGS. 4 through 6, gap 62 preferably is below the bottom of inlet 18 and outlet 20. In addition, the low liquid level position preferably is above the top of inlet 18 and outlet 20 such that a liquid seal is maintained and little, if any, motive gas exits the pump body through outlet 20. Furthermore, the cross-sectional area of gap 62 preferably is greater than the cross-sectional area of outlet 20.

While one or more preferred embodiments of the invention have been described above, it should be understood that any and all equivalent realizations of the present invention are included within the scope and spirit thereof. The embodiments depicted are presented by way of example and are not intended as limitations upon the present invention. Thus, those of ordinary skill in this art should understand that the present invention is not limited to these embodiments since modifications can be made. Therefore, it is contemplated that any and all such embodiments are included in the present invention as may fall within the scope and spirit thereof.

What is claimed:

1. A gas pressure driven liquid pump, said pump comprising:

a pump body, the pump body having a liquid inlet and a liquid outlet;

a plurality of liquid level indicators, the liquid level indicators being configured to detect a liquid level within the pump body;

a baffle within the pump body, the baffle separating the pump body into a first side and a second side, at least one of the plurality of liquid level indicators configured to detect the liquid level within the first side and at least one of the plurality of liquid level indicators configured to detect the liquid level within the second side;

a void defined by the baffle so as to provide liquid communication there between;

wherein a high liquid level position within one of the first side and the second side triggers fluid communication with a motive gas source such that the liquid within the pump body will flow through the liquid outlet; and wherein the low liquid level position within one of the first side and the second side triggers fluid communication with an exhaust such that the liquid is allowed to flow into the pump body through the liquid inlet.

2. The gas pressure driven liquid pump of claim 1 wherein the void is a gap between the baffle and the pump body's bottom.

3. The gas pressure driven liquid pump of claim 1 further comprising a passage providing fluid communication between the pump body's first side and second side, the passage being located above the predetermined high liquid level position.

4. The gas pressure driven liquid pump of claim 3 wherein the passage between the pump body's first side and second side is formed by an equalizing tube.

5. The gas pressure driven liquid pump of claim 1 wherein any liquid level indicator configured to detect the liquid level in the first side operates substantially independently of any liquid level indicator configured to detect the liquid level in the second side.

6. The gas pressure driven liquid pump of claim 1 wherein at least one of said liquid level indicators is a float assembly.

7. The gas pressure driven liquid pump of claim 1 wherein the pump body's first side and second side are of approximately equal volume.

8. The gas pressure driven liquid pump of claim 1 wherein the baffle is located about halfway between the liquid inlet and the liquid outlet.

9. The gas pressure driven liquid pump of claim 1 wherein the baffle divides the pump body's interior longitudinally, the baffle also dividing the liquid inlet and the liquid outlet where the liquid inlet and liquid outlet intersect the pump body.

10. The gas pressure driven liquid pump of claim 9 wherein the void is below the bottom of the liquid inlet and liquid outlet.

11. The gas pressure driven liquid pump of claim 9 wherein the low liquid level position is above the top of the liquid inlet and liquid outlet.

12. The gas pressure driven liquid pump of claim 1 wherein the cross-sectional area of the gap is greater than the cross-sectional area of the liquid outlet.

13. A gas pressure driven liquid pump, said pump comprising:

a pump body, the pump body having a liquid inlet and a liquid outlet;

a plurality of pump mechanisms mounted to the pump body, each pump mechanism having a gas motive port and a gas exhaust port;

a baffle within the pump body, the baffle separating the pump body into a first side and a second side;

wherein a predetermined high liquid level within one of the first side and the second side triggers the respective gas motive port to open, the respective gas exhaust port to close, and liquid to flow through the liquid outlet;

wherein a predetermined low liquid level within one of the first side and the second side triggers the respective gas motive port to close and the respective gas exhaust port to open;

wherein at least one respective pump mechanism is in fluid communication with the pump body's first side and the pump body's second side, respectively;

a void defined in said baffle so as to provide liquid communication between said first side and said second side.

14. The gas pressure driven liquid pump of claim 13 further comprising a passage providing fluid communication between the pump body's first side and second side, the passage being located above the predetermined high liquid level position.

15. The gas pressure driven liquid pump of claim 13 wherein the baffle divides the pump body's interior longitudinally, the baffle also dividing the liquid inlet and the liquid outlet where the liquid inlet and liquid outlet intersect the pump body.

16. The gas pressure driven liquid pump of claim 13 wherein the void is below the bottom of the liquid inlet and liquid outlet.

17. The gas pressure driven liquid pump of claim 16 wherein the void is below the predetermined low liquid level.

18. The gas pressure driven liquid pump of claim 13 wherein the low liquid level position is above the top of the liquid inlet and liquid outlet.

* * * * *